US009938668B2

(12) United States Patent
Harkness et al.

(10) Patent No.: US 9,938,668 B2
(45) Date of Patent: Apr. 10, 2018

(54) ANCHORING DEVICES FOR RAIL FASTENING CLIPS

(71) Applicant: PANDROL AUSTRALIA PTY LTD, Wingfield, South Australia (AU)

(72) Inventors: Steven Harkness, Wingfield (AU); Brenton Keast, Wingfield (AU); Pierre Barthram, Wingfield (AU); Jozef Nevidal, Wingfield (AU)

(73) Assignee: PANDROL AUSTRALIA PTY LTD. (AU)

( * ) Notice: Subject to any disclaimer, the term of this patent is extended or adjusted under 35 U.S.C. 154(b) by 357 days.

(21) Appl. No.: 14/425,035

(22) PCT Filed: Aug. 30, 2013

(86) PCT No.: PCT/AU2013/000979

§ 371 (c)(1),
(2) Date: Feb. 28, 2015

(87) PCT Pub. No.: WO2014/032114

PCT Pub. Date: Mar. 6, 2014

(65) Prior Publication Data

US 2015/0211191 A1 Jul. 30, 2015

(30) Foreign Application Priority Data

Aug. 31, 2012 (AU) ..... 2012903815

(51) Int. Cl.
*E01B 9/30* (2006.01)
*E01B 9/18* (2006.01)

(52) U.S. Cl.
CPC ..... *E01B 9/30* (2013.01); *E01B 9/18* (2013.01); *E01B 9/303* (2013.01)

(58) Field of Classification Search
CPC ..... E01B 9/18; E01B 9/30; E01B 9/303
See application file for complete search history.

(56) References Cited

U.S. PATENT DOCUMENTS 4,307,837 A * 12/1981 Leingang ..... E01B 9/30 238/282
4,442,973 A * 4/1984 Fee ..... E01B 9/303 238/338
4,588,126 A 5/1986 Foulart et al.
4,625,912 A * 12/1986 Fee ..... E01B 9/303 238/338
4,679,293 A * 7/1987 Bryan ..... E01B 9/303 238/349

(Continued)

FOREIGN PATENT DOCUMENTS

GB 1305871 A 2/1973
GB 2261241 A 5/1993

*Primary Examiner* — Zachary L Kuhfuss
(74) *Attorney, Agent, or Firm* — Klauber & Jackson LLC

(57) ABSTRACT

This invention relates to an anchoring device for use in retaining a railway rail fastening clip, the device comprising a stem for embedding in a rail support member, a head extending from the stem and comprising a generally hook-shaped portion for extending over a portion of the clip to effect retention and terminating at an end apart from the stem, and wherein in use, said end terminates at a sealing plate for bridging the end of the hook-shaped portion and the stem. An associated anchoring device assembly and railway rail fastening assembly are also disclosed.

15 Claims, 5 Drawing Sheets

(56) References Cited

U.S. PATENT DOCUMENTS

| | | | | | |
|---|---|---|---|---|---|
| 4,688,719 | A * | 8/1987 | Young | E01B 9/30 | 238/350 |
| 4,715,534 | A * | 12/1987 | Fee | E01B 9/303 | 238/338 |
| 4,934,594 | A | 6/1990 | Harkus | | |
| 2009/0218410 | A1 * | 9/2009 | Cox | E01B 3/28 | 238/343 |

* cited by examiner

ANCHORING DEVICES FOR RAIL FASTENING CLIPS

CROSS REFERENCE TO RELATED APPLICATIONS

The present application is a National Stage Application claiming the priority of co-pending PCT Application No. PCT/AU2013/000979 filed Aug. 30, 2013, which in turn, claims priority from Australian application No. 2012903815, filed Aug. 31, 2012. Applicants claim the benefits of 35 U.S.C. § 120 as to the PCT application and priority under 35 U.S.C. § 119 as to the said Australian application, and the entire disclosures of both applications are incorporated herein by reference in their entireties.

TECHNICAL FIELD

The present invention relates to railway system construction. More particularly, the present invention relates to anchoring devices for rail fastening clips.

BACKGROUND

In railway system construction it is common practice for each rail to be secured to a support member or sleeper using a support plate which is located between a foot of the rail and a supporting surface of the sleeper. Such a support plate may include, for example, a "tie plate" or a "turnout plate". There is also an anchoring device anchored to the sleeper on each side of the rail (hence they are called shoulders) retaining a fastening clip which bears against the foot of the rail.

Anchoring devices suitable for use in anchoring a railway rail fastening clip to a rail foundation are commonly known as shoulders.

Whilst other techniques are used, it is known to manufacture these anchoring devices or shoulders via sand casting of molten metal.

Cast metal parts are generally heavy, and if voids are required to retain the rail fastening clip, and they generally are, then separate cores will be required to form these, adding to the complexity and expense of the casting process.

It is against this background and the problems and difficulties associated therewith that the present invention has been developed.

Certain objects and advantages of the present invention will become apparent from the following description, taken in connection with the accompanying drawings, wherein, by way of illustration and example, an embodiment of the present invention is disclosed.

SUMMARY

According to a first aspect, there is provided an anchoring device for use in retaining a railway rail fastening clip, the device comprising a stem for embedding in a rail support member, a head extending from the stem and comprising portion for extending over a portion of the clip to effect retention and terminating at an end apart from the stem, and wherein in use, said end terminates at a sealing plate for bridging the end of the hook-shaped portion and the stem.

In one form, the portion for extending over a portion of the clip to effect retention is generally hook-shaped.

In one form, the hook-shaped portion comprises a means for engaging the sealing plate at or near the end thereof.

In one form, the stem comprises a means for engaging the sealing plate.

In one form, the clip is approximately 'e' shaped.

In one form, the head defines a recess for receiving a portion of the clip.

In one form, the recess is a slot.

In one form, the slot shaped recess extends into the head at an angle relative to the longitudinal axis of the stem, and which is inclined towards a corner defined between the head and the stem.

In one form, the stem is approximately Y-shaped, and comprises portions forming upper ends of the Y for connecting the stem to the head of the device. Of course the stem need not be Y-shaped, instead it may be of substantially constant cross section throughout its length, and/or solid throughout its length.

In one form, the anchoring device is formed by a casting process.

In one form, the anchoring device is shaped for casting without a core.

In one form, the recess for receiving a portion of the clip is shaped for casting without a core.

In one form, the end of the hook-shaped portion is unsecured, and in alternative the end of the hook-shaped portion is secured to or with respect to the rail support member.

In a further aspect, there is provided an anchoring device for use in retaining a railway rail fastening clip, the device comprising a stem for embedding in a rail support member, and which comprises a means for engaging a sealing plate, a head extending from the stem and comprising a generally hook-shaped portion for extending over a portion of the clip to effect retention and terminating at an end apart from the stem, where the end comprises a means for engaging the sealing plate, and wherein in use, said end terminates at a sealing plate bridging the end of the hook-shaped portion and the stem.

In one form, in the region where the stem transitions into the hook-shaped portion a cross-sectional shape of the stem is varied so as to provide a resistance to any loads resulting in a turning moment about a longitudinal axis of the stem.

In one form, in the region where the stem transitions into the hook-shaped portion a cross-sectional shape of the stem is varied so as to provide a resistance to any loads resulting in a turning moment about a longitudinal axis of the stem.

In a further aspect the invention may be said to reside in a cast anchoring device for use in retaining a railway rail fastening clip, the device comprising a stem for embedding in a rail support member, a head extending from the stem and comprising a generally hook-shaped portion for extending over a portion of the clip to effect retention and terminating at an end apart from the stem.

For the purpose of this specification the term 'cast' means to make by casting, which is a process whereby a liquid material, such as molten metal or similar, is shaped in a mould.

In a further aspect the invention may be said to reside in an anchoring device for use in retaining a railway rail fastening clip, the device comprising a stem for embedding in a face of a rail support member, a head extending from the stem and comprising a generally hook-shaped portion for extending over a portion of the clip to effect retention and terminating at an end apart from the stem, and wherein in use, said end terminates at or near the face of the rail support member.

By saying that the end of the generally hook-shaped portion terminates 'at or near the face of the rail support member', it is meant that in the case that the end penetrates the support member, it does not do so to any great extent or depth, only slightly, or to a small degree.

In one form, the end of the generally hook-shaped portion does not penetrate the support member.

In a further aspect the invention may be said to reside in a railway rail fastening assembly comprising a resilient railway rail fastening clip and an anchoring device as described above, wherein the head is generally hook-shaped, and extends over a portion of the clip to effect retention of the rail to the sleeper.

In a further aspect the invention may be said to reside in a cast anchoring device for use in retaining a railway rail fastening clip, the device comprising a stem for embedding in a rail support member, and a head extending from the stem shaped both for retaining the clip and casting thereof without a core.

A detailed description of one or more embodiments of the invention is provided below along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention.

The present invention may be practiced according to the claims without some or all of these specific details. For the purpose of clarity, technical material that is known in the technical fields related to the invention has not been described in detail so that the present invention is not unnecessarily obscured.

BRIEF DESCRIPTION OF DRAWINGS

Embodiments of the present invention will be discussed with reference to the accompanying drawings wherein.

In the following description, like reference characters designate like or corresponding parts throughout the figures.

DESCRIPTION OF EMBODIMENTS

Referring now to FIGS. 1 through 8, where there is illustrated an embodiment of an anchoring device 1 of the type commonly known as 'a shoulder' (so these terms are hereinafter used interchangeably) and suitable for use in anchoring a railway rail-fastening clip to a rail foundation.

The anchoring device 1 comprises a stem 1B and a generally hook-shaped head 1A. The stem 1B is, in this embodiment, substantially Y-shaped: it is connected to the head 1A by upper portions 12 of the Y, and it comprises a barb 14 at a point toward a terminal end thereof.

The anchoring device 1 illustrated in FIGS. 1 through 8 is manufactured using a sand casting process, resulting in an anchoring device 1 which is formed from a single, integral piece of cast iron. However, it is also possible that the anchoring device 1 could be manufactured from other materials (or indeed formed by another method), such as composites, or other metals, or indeed any other material sufficient to withstand the load exerted thereon by carriage of a train. Moreover, conceivably though less desirably, anchoring device 1 could be assembled from separate pieces of material.

Figure 2:
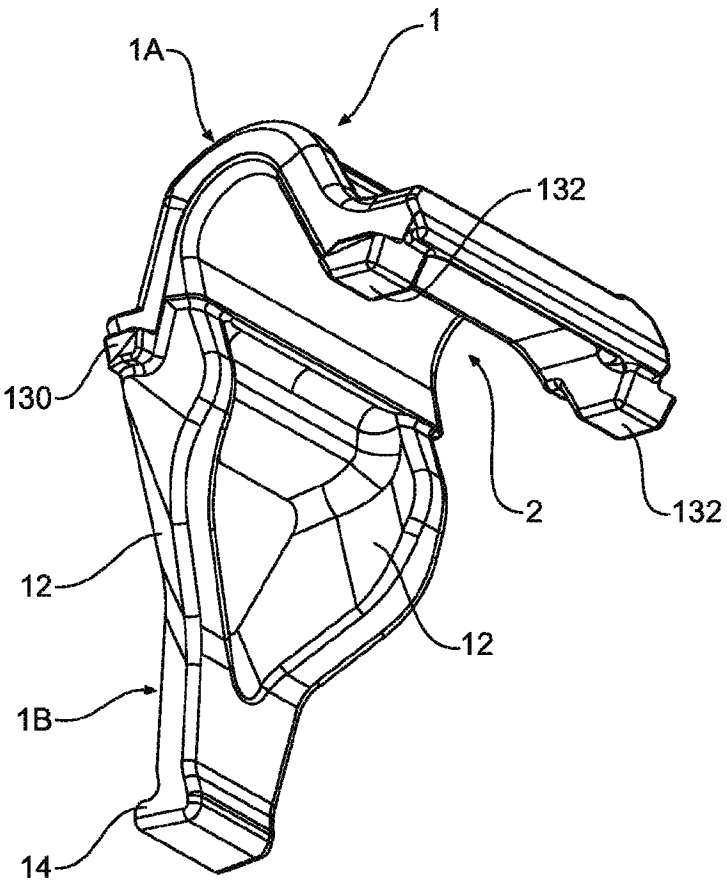
FIG. 2 is a lower isometric view of the anchoring device of FIG. 1.
Figure 1:
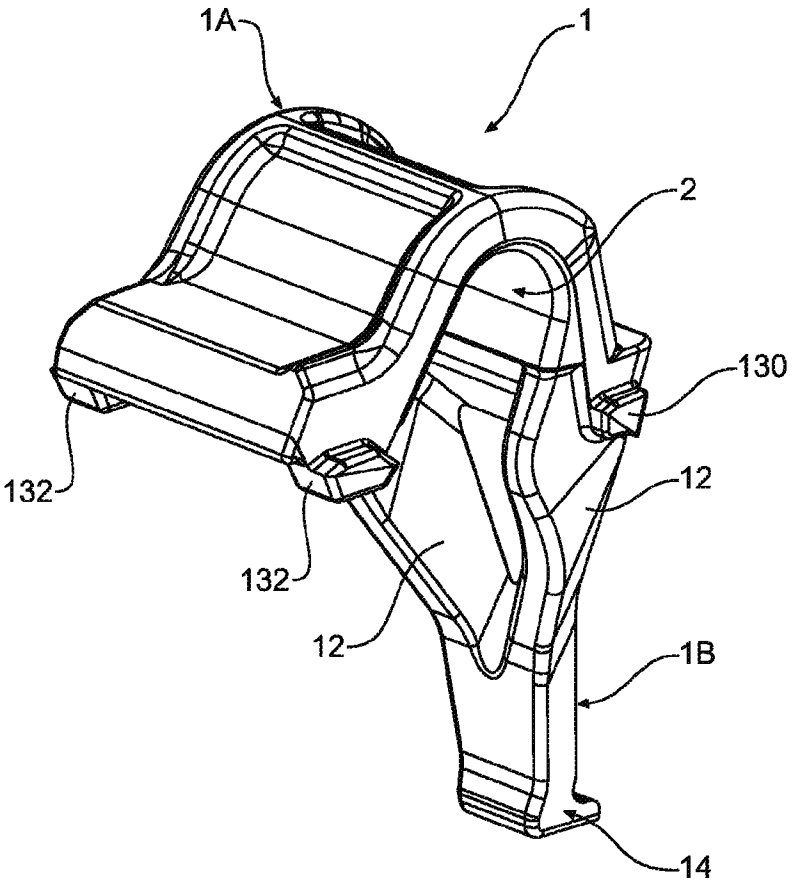
FIG. 1 is an upper isometric view of an anchoring device.
Figure 4:
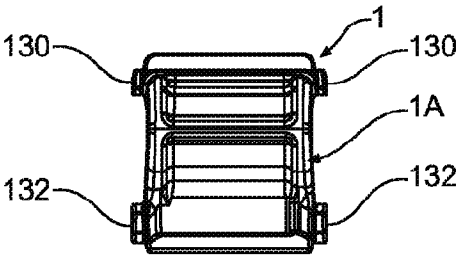
FIG. 4 is a top view of the anchoring device.
Figure 7:
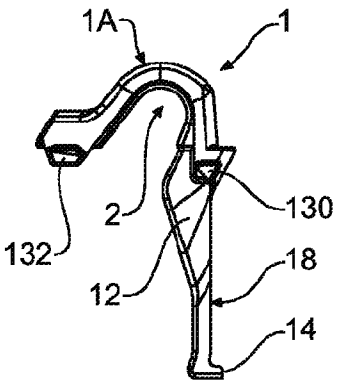
FIGS. 6 and 7 are opposing side views of the anchoring device.
Figure 3:
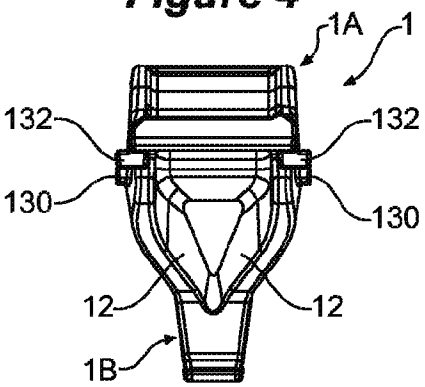
FIG. 3 is a front view of the anchoring device.
Figure 5:
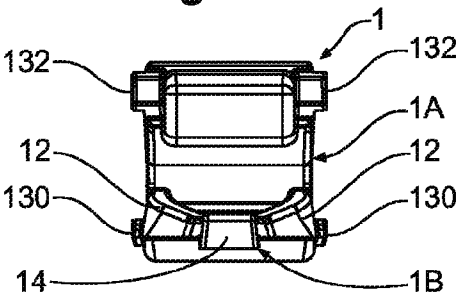
FIG. 5 is a bottom view of the anchoring device.
Figure 6:
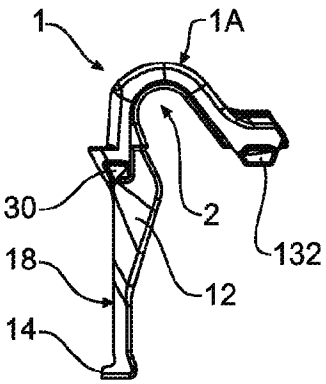
Figure 8:
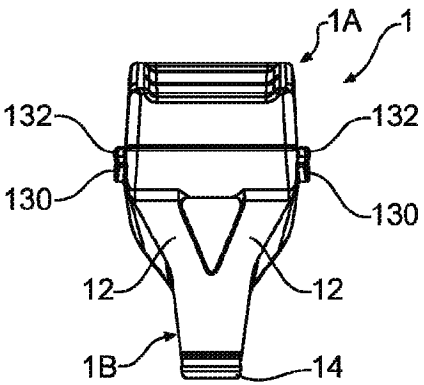
FIG. 8 is a rear view of the anchoring device.
Figure 9:
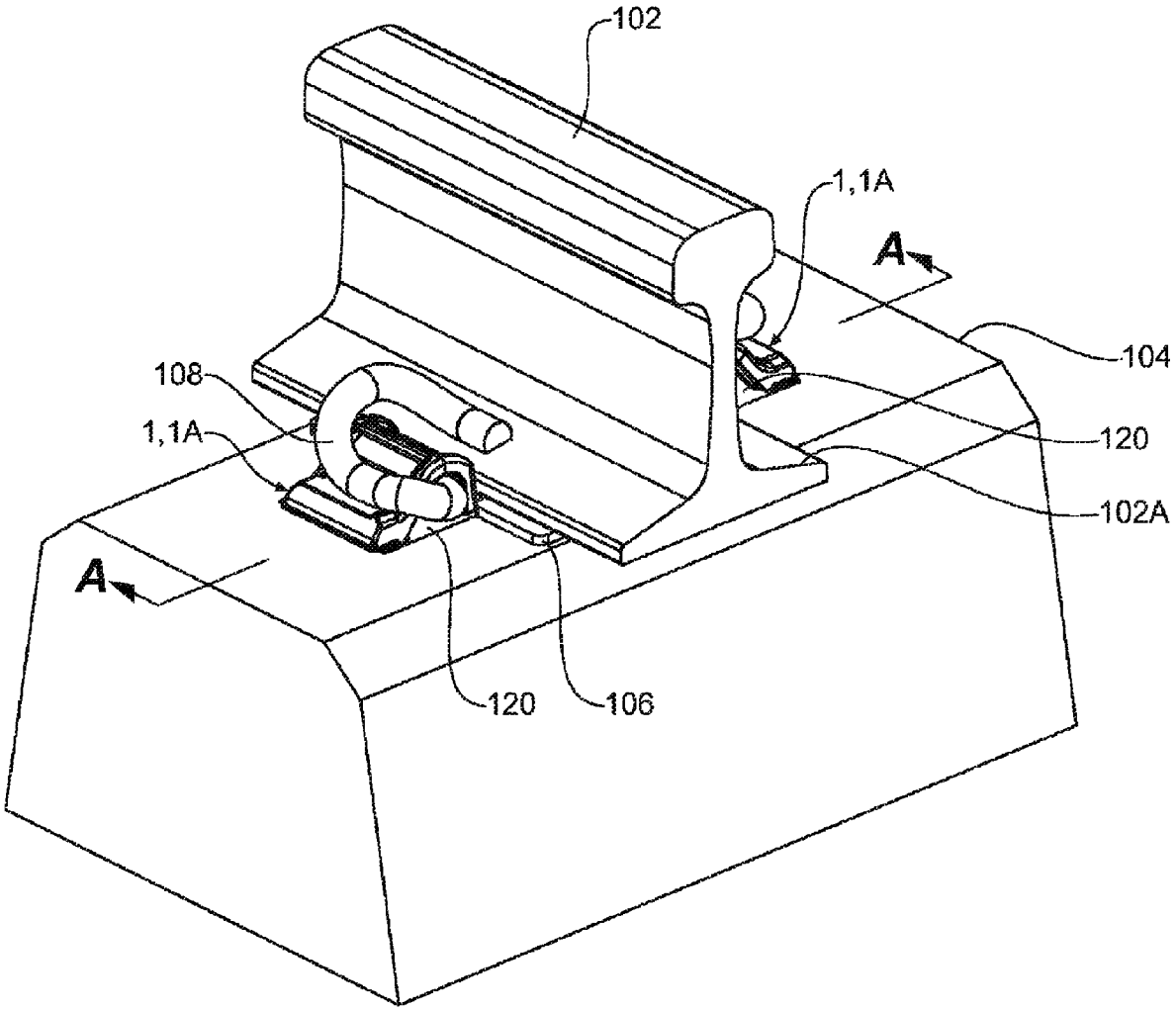
FIG. 9 is a top isometric view of a railway rail fastening assembly comprising the anchoring device of FIGS. 1 through 8.
Figure 10:
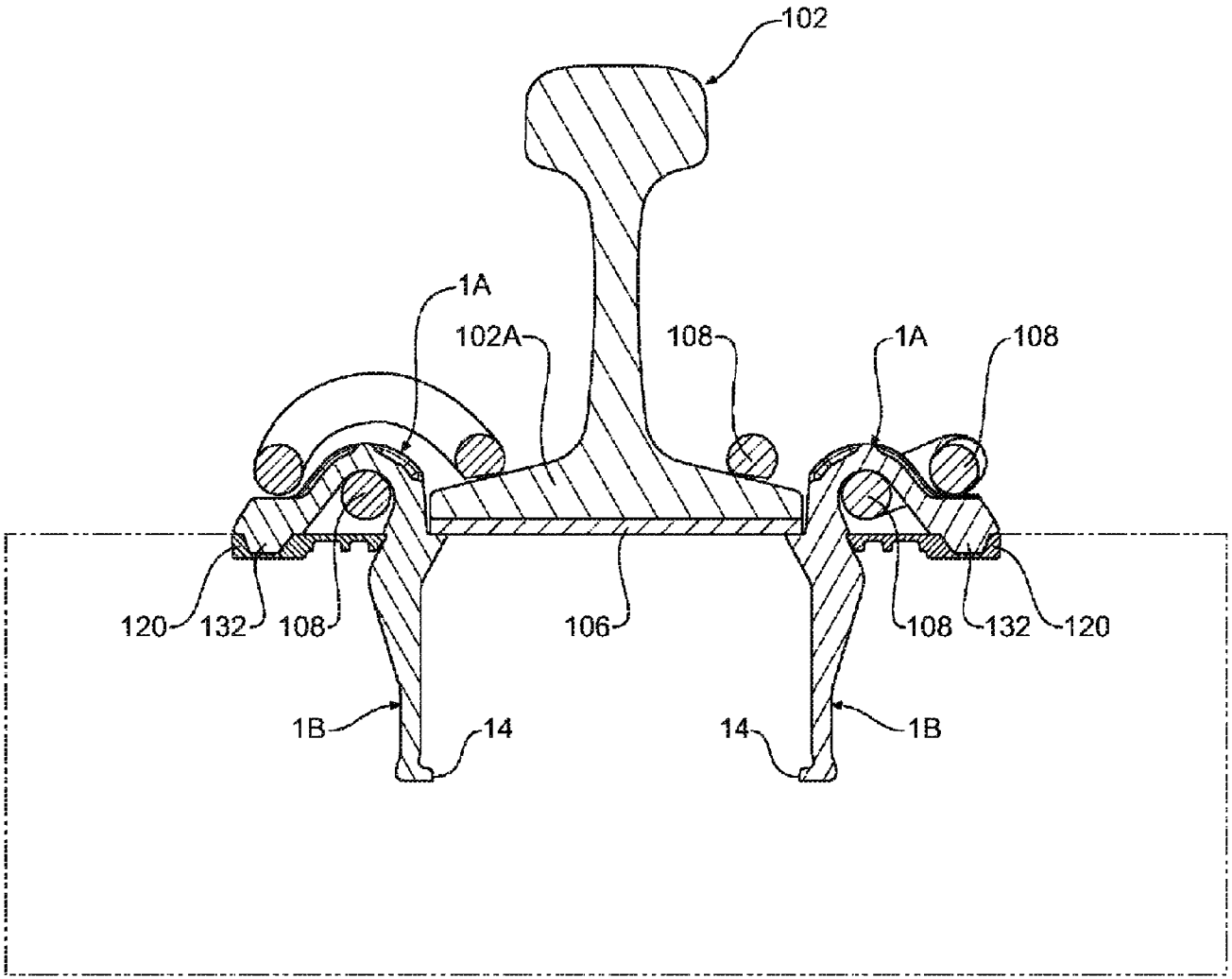
FIG. 10 is a cross-sectional view through the railway rail fastening assembly of FIG. 9.

Referring now to FIGS. 9 and 10, where there is illustrated a railway rail fastening assembly 100 comprising a rail 102 to be secured to a support member or sleeper 104 (so these terms are hereinafter used interchangeably) using a support plate 106 which is located between a foot 102A of the rail 102 and a supporting surface of the sleeper 104. Such a support plate 106 may include, for example, a "tie plate" or a "turnout plate". There is an anchoring device 1 anchored to the sleeper 104 on each side of the rail 102 (hence they are called shoulders) retaining a generally 'e' shaped fastening clip 108 which bears against the foot of the rail 102.

The generally hook-shaped head 1A of the shoulder 1 extends over and around a portion of the clip 108 by defining in the underside thereof a slot-shaped recess 2 with a downwardly directed opening for receiving and capturing the portion of the clip 108.

Typically, these anchoring devices or shoulders 1 are secured to a concrete railway sleeper 104 by embedding the stem 1B of the shoulder 1 in the concrete during manufacture of the sleeper 104. Once embedded, the barb 14 resists withdrawal of the stem 10 from the concrete.

The concrete sleepers 104 are manufactured upside down, so that the top of the finished sleeper 104 is formed by a floor of a mould. During manufacture, the parts of the shoulder 1 that stick up above the finished sleeper, namely the head 1A, protrude down through apertures cut into the floor of the mould at appropriate positions for this purpose. The stems 1B of the shoulders 1 that end up cast into the concrete sleeper 104 stick up into the mould before the concrete is poured. When the concrete has been poured and allowed to set, the sleepers 104 are lifted out of the moulds and turned the right way up.

A difficulty with this process is that if the apertures in the bottom of the mould pockets are not a close fit around the stems 1B of the shoulders 1, then concrete will leak through the gap and it may then set on to parts of the shoulder 1 above the finished concrete level (ie the head 1A) and prevent the clip 108 from engaging properly. Alternatively, this unwanted concrete must be removed via a time consuming and therefor costly cleaning operation before the clip 108 will fit properly.

A solution to this problem involves placing a sealing plate 120 (see FIGS. 8 and 9) around the stem 1B near the underside of the head 1A of the anchoring device 1, and over the aperture in the floor of the mould before the concrete is introduced into the mould. It this way the sealing plate 120 seals the aperture in the mould and prevents the ingress of concrete into the head 1A of the shoulder 1.

Post forming, the sealing plate 120 is molded (embedded) into the top of the concrete sleeper 104 (see FIG. 9), such that its top face is flush with the face of the top surface of the concrete on the sleeper 104 top.

Figure 12:
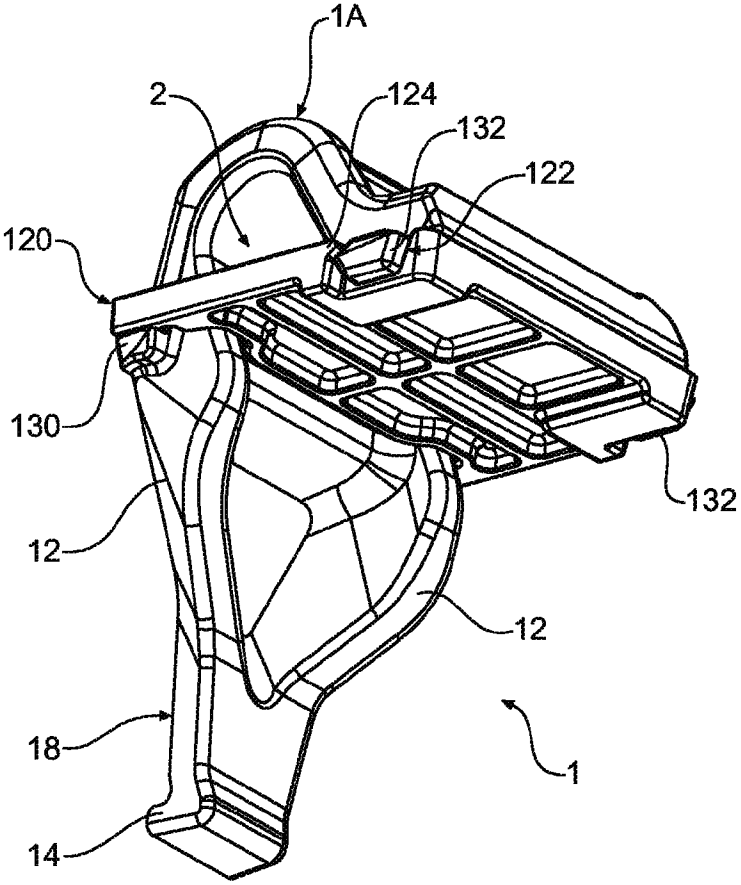
FIG. 12 is a lower isometric view of the anchoring device assembly of FIG. 11.
Figure 11:
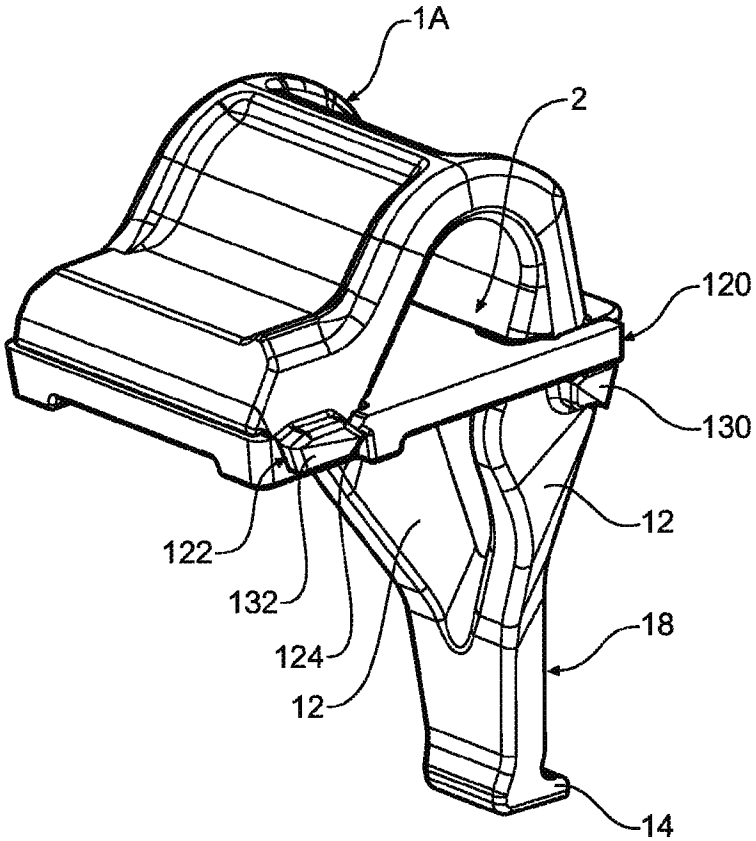
FIG. 11 is an upper isometric view of an anchoring device assembly comprising the anchoring device of FIG. 1, and a sealing plate.

Before either of the anchoring device 1 or the sealing plate 120 are introduced into the mould, they are connected so as to form an anchoring device assembly, as illustrated in FIGS. 11 and 12. The end of the hook-shaped portion of the head 1A and the stem 1B each comprise a means for engaging the sealing plate 120, being in this embodiment, in the form of tabs 130 on the stem 1B, and lugs 132 on the end of the hook-shaped portion of the head 1A (although slots would be an alternative). Moreover, the sealing plate 120 comprises a pair of sockets 122 for receiving the lugs 132, each socket comprising a shoulder 124 for capturing the lug 132 with a 'snap-fit'. The sealing plate 120 locates (interlocks) between the tabs 130 and lugs 132 and bridges the stem 1B and the end of the hook-shaped portion to accurately position the sealing plate 120 ready for concrete pouring. In this way, the sealing plate 120 prevents concrete slurry from filling the slot-shaped recess 2.

The Y-shaped stem 1B allows some weight to be saved relative to existing shoulders. Moreover, and possibly more importantly, the Y-shape stem 1B provides resistance to any loads resulting in a turning moment about a longitudinal axis of the stem 1B, thereby eliminating the requirement that a portion of the head 1A be embedded directly in the concrete of the sleeper, as is the case with many shoulders of the prior art, such as the retaining member disclosed in patent GB 1,585,599 for instance.

The slot shaped recess 2 for the clip 108 extends from its downward facing opening into the head 1A at an angle relative to the longitudinal axis of the stem 1B and which is inclined towards a corner defined between the head 1A and the stem 1B. In use, this brings the retained clip 108 into near alignment with the stem 1B (see FIG. 9), aiding retention of the clip 108 by the shoulder 1 by making for a more direct load path to the concrete sleeper 104.

A further advantage of the slot shaped recess 2 for the clip 108 extending into the head 1A at an angle relative to the longitudinal axis of the stem 1B is that it permits casting of the shoulder 1, and particularly the slot shaped recess 2, without need for a core of the type required to form a closed void. Instead, shoulder 1 can be cast in a substantially V-shaped mould cavity, and extracted therefrom without difficulty.

Retaining members of the type disclosed in patent GB 1,585,599 are fabricated from sheet steel in an involved and staged fabrication process, which included the steps of forming the blank, followed by a staged bending process. This manufacturing process is labour intensive and potentially costly. Casting the shoulder 1 ameliorates this difficulty, and allows the shoulder 1 to include detail features for engaging sealing plate 120, and for additional material to be included at points which require additional strength. In this way, the end of the hook-shaped portion need not be embedded in the rail support element in the way that it is for retaining members of the type disclosed in patent GB 1,585,599.

In addition to all of the above, the resultant shoulder 1 has a relatively open structure compared with shoulders which define voids and the like, which contributes to weight reduction of the shoulder 1 by requiring less material.

Railway system construction involves transporting large numbers of components across large distances. Typically the components are transported in high volume containers, such as shipping containers. Such transportation incurs significant transport costs. Indeed, the transportation demands are such that even a slight reduction in component weight can lead to a significant reduction in transportation costs. For example, because some transportation systems are weight restricted, a reduction in the weight of a particular component may mean that a larger number of those components may be transported for a particular weight restriction.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. An anchoring device for use in retaining a railway rail fastening clip, the device comprising a stem for embedding in a rail support member, the stem comprising a means for engaging a sealing plate, a head extending from the stem and comprising a generally hook-shaped portion for extending over a portion of the clip to effect retention and terminating at an end apart from the stem, where the end comprises a means for engaging the sealing plate, and wherein in use, said end terminates at the sealing plate when the sealing plate bridges the engaging means on both the end of the hook-shaped portion and the stem.

2. The anchoring device of claim 1, wherein the hook-shaped portion of the head defines a recess comprising an opening for receiving said portion of the clip, and which is defined between the stem and the end of the hook-shaped portion.

3. The anchoring device of claim 2, wherein the recess is a slot extending from the opening.

4. The anchoring device of claim 3, wherein the slot shaped recess extends from its opening into the head at an angle relative to the longitudinal axis of the stem, and which is inclined towards a corner defined between the head and the stem.

5. The anchoring device of claim 1, wherein the stem is approximately Y-shaped, and comprises portions forming upper ends of the Y for connecting the stem to the head of the device.

6. The anchoring device of claim 1, wherein the anchoring device is formed by a casting process, and the recess is shaped for casting without a core.

7. A railway rail fastening assembly comprising a railway rail fastening clip for retaining the rail, an anchoring device as in claim 1, and a sealing plate bridging the stem and the end of the hooked-shaped portion of the head.

8. The railway rail fastening assembly of claim 7, wherein in use, the rail support member is formed using a concrete moulding process, and the stem of the anchoring device is embedded in the rail support member during the moulding process, and the sealing plate prevents the concrete slurry from entering the slot shaped recess during the concrete moulding process.

9. The railway rail fastening assembly of claim 7, wherein the sealing plate is embedded in the rail support member during the moulding process.

10. The railway rail fastening assembly of claim 7, wherein the sealing plate comprises a means for engaging a portion of the anchoring device.

11. The railway rail fastening assembly of claim 7, wherein the sealing plate interlocks between the stem and the end of the hook-shaped portion to accurately position the sealing plate.

12. The anchoring device of claim 1, wherein in the region where the stem transitions into the hook-shaped portion, a shape of the stem is varied so as to provide a resistance to any loads resulting in a turning moment about a longitudinal axis of the stem.

13. The anchoring device of claim 1, wherein this is formed from a single, integral piece of cast iron.

14. The anchoring device of claim 1, wherein in the region where the stem transitions into the hook-shaped portion a cross-sectional shape of the stem is varied so as to provide a resistance to any loads resulting in a turning moment about a longitudinal axis of the stem.

15. An anchoring device for use in retaining a railway rail fastening clip, the device comprising a stem for embedding in a rail support member, the stem comprising a means for engaging a sealing plate, a head extending from the stem and comprising a generally hook-shaped portion for extending over a portion of the clip to effect retention, and terminating at an end apart from the stem, where the end comprises a means for engaging the sealing plate, wherein in the region where the stem transitions into the hook-shaped portion a shape of the stem is varied, and wherein in use, said end terminates at the sealing plate when the sealing plate bridges the engaging means on both the end of the hook-shaped portion and the stem.

* * * * *